US012590783B2

(12) United States Patent
Milo

(10) Patent No.: US 12,590,783 B2
(45) Date of Patent: Mar. 31, 2026

(54) FORWARD-FIGHTING POSITION BALLISTIC SHIELD DEVICE

(71) Applicant: Thomas K Milo, Cuyahoga Falls, OH (US)

(72) Inventor: Thomas K Milo, Cuyahoga Falls, OH (US)

( * ) Notice: Subject to any disclaimer, the term of this patent is extended or adjusted under 35 U.S.C. 154(b) by 0 days.

(21) Appl. No.: 19/072,010

(22) Filed: Mar. 6, 2025

(65) Prior Publication Data

US 2025/0305799 A1 Oct. 2, 2025

Related U.S. Application Data

(60) Provisional application No. 63/569,863, filed on Mar. 26, 2024.

(51) Int. Cl.
*F41H 5/08* (2006.01)

(52) U.S. Cl.
CPC ..... *F41H 5/08* (2013.01)

(58) Field of Classification Search
CPC ..... F41H 5/08; F41H 5/013
See application file for complete search history.

(56) References Cited

U.S. PATENT DOCUMENTS 1,212,463 A * 1/1917 Doran ..... F41H 5/26 2/2.5
1,256,562 A * 2/1918 Hoffmann ..... F41H 5/08 109/49.5
1,282,752 A * 10/1918 Carrino ..... F41H 5/08 2/2.5
3,745,938 A * 7/1973 Hathaway ..... F41H 5/08 2/2.5
4,674,394 A * 6/1987 Martino ..... F41H 5/08 2/2.5
4,782,735 A * 11/1988 Mui ..... F41H 5/08 89/36.13
6,367,427 B1 * 4/2002 Canady ..... A61F 5/05825 5/81.1 R
7,124,675 B1 * 10/2006 Sand ..... F41H 5/08 89/36.07
7,716,748 B2 * 5/2010 Dovner ..... F41C 33/0209 89/36.01

(Continued)

*Primary Examiner* — Joshua E Freeman
(74) *Attorney, Agent, or Firm* — Brennan, Manna & Diamond, LLC

(57) ABSTRACT

A forward-fighting ballistic shield device is provided. The device is comprised of a ballistic shield device that can function as both a ground-deployed and a carried shield to protect against ballistic blast and fragmentation impacts. The device comprises an aluminum frame attached to a ballistic panel with a polyurethane coating, along with an adjustable telescopic leg secured by a locking mechanism for stability when deployed. A tether further ensures the leg maintains the desired angle, while a fastener secures it parallel to the frame when carried. Additionally, deployable straps with grommets enable staking the device to the ground for enhanced stability. The device further features a rapidly inflatable ballistic panel with an inflatable bladder, capable of being manually or gas-inflated via a canister. The bladder may be reinforced with tensile members or foam-core and absorbs and distributes impact forces.

20 Claims, 5 Drawing Sheets

(56) References Cited

U.S. PATENT DOCUMENTS

| | | | | |
|---|---|---|---|---|
| 2006/0230916 | A1* | 10/2006 | Sand | F41H 3/00 89/36.07 |
| 2019/0145740 | A1* | 5/2019 | Czerski | B32B 5/02 2/463 |
| 2021/0270574 | A1* | 9/2021 | Bopp | F41H 5/0471 |
| 2024/0426581 | A1* | 12/2024 | Speyer | F41H 5/08 |

* cited by examiner

FORWARD-FIGHTING POSITION BALLISTIC SHIELD DEVICE

CROSS-REFERENCE TO RELATED APPLICATION

The present application claims priority to, and the benefit of, U.S. Provisional Application No. 63/569,863, which was filed on Mar. 26, 2024, and is incorporated herein by reference in its entirety.

FIELD OF THE INVENTION

The present invention relates generally to the field of ballistic shields. More specifically, the present invention relates to a ballistic shield that functions as both a ground-deployed and carried shield, featuring a frame with a ballistic panel, a polyurethane coating, an adjustable telescopic leg for stability, a tether for angle control, and deployable straps for ground staking. The device also includes a rapidly inflatable ballistic panel with a reinforced bladder for impact absorption and a removable ballistic insert offering various NIJ protection levels. Accordingly, the present disclosure makes specific reference thereto. Nonetheless, it is to be appreciated that aspects of the present invention are also equally applicable to other like applications, devices, and methods of manufacture.

BACKGROUND

Individuals in combat situations often require protective cover to shield themselves from projectile impacts, blasts, and fragmentation. Traditional cover solutions include natural terrain features, fixed fortifications, and manually carried shields. However, these options present significant limitations. Fixed fortifications and natural cover, such as walls or sandbags, are immovable and require prior positioning, making them impractical for dynamic combat scenarios. Manually carried shields, while mobile, are often heavy and cumbersome, reducing a user's agility and operational effectiveness. Some existing mobile ballistic shields offer protection but lack the ability to be quickly deployed as stationary barriers. Furthermore, shields designed for ground deployment frequently lack adjustability, which limits their adaptability to different battlefield conditions. The weight and bulkiness of these shields also pose logistical challenges, particularly when transporting them across difficult terrain. Additionally, traditional shields typically require the user to hold them at an extended distance, which can lead to fatigue and limit their effectiveness over prolonged engagements. Given these constraints, there is a need for an improved ballistic shield that combines mobility, adaptability, and ease of deployment to enhance combat effectiveness.

Therefore, there exists a long-felt need in the art for an improved blast, fragmentation, and ballistic shield that provides both mobile and stationary protection while maintaining user maneuverability. There also exists a long-felt need in the art for a forward-fighting position ballistic shield device that can be used as a free-standing, angled ground shield and as a carried shield to adapt to different combat scenarios. Moreover, there exists a long-felt need in the art for a ballistic shield that incorporates rapid deployment features, including an inflatable ballistic panel, to enhance protection without significantly increasing weight or bulk.

The subject matter disclosed and claimed herein, in one embodiment thereof, comprises a forward-fighting ballistic shield device. The device is comprised of a ballistic shield device that can function as both a ground-deployed and a carried shield to protect against ballistic fragmentation and blast impacts. The device comprises an aluminum frame attached to a ballistic panel with a polyurethane coating, along with an adjustable telescopic leg secured by a locking mechanism for stability when deployed. A tether further ensures the leg maintains the desired angle, while a fastener secures it parallel to the frame when carried. Additionally, deployable straps with grommets enable staking the device to the ground for enhanced stability. The device further features a rapidly inflatable ballistic panel with an inflatable bladder, capable of being manually or gas-inflated via a canister. The bladder may be reinforced with tensile filaments and/or foam-core which absorbs and distributes impact forces. A ballistic insert is also positioned in front of the bladder to enhance protection, with removable options for varying NIJ protection levels.

In this manner, the forward-fighting ballistic shield device of the present invention accomplishes all the forgoing objectives and provides an improved ballistic shield that incorporates an adjustable leg with a multi-point spring hinge, allowing it to function as a stable ground-deployed shield with customizable angles. The leg is further equipped with a locking mechanism and tether system to maintain the desired positioning. When used as a carried shield, the leg can be secured to the frame, ensuring compactness and ease of transport. The rapidly inflatable ballistic panel with an integrated bladder system further provides additional protection while maintaining a low-profile storage state. The inflatable panel is reinforced with ballistic inserts, offering varying levels of protection against projectiles. Additionally, the panel includes arm straps and an adjustable handle for ergonomic handling, allowing it to move as an extension of the user's body. By combining modular functionality, rapid deployment capabilities, and enhanced protection, the device addresses the limitations of existing shields and provides a versatile solution for dynamic combat environments.

SUMMARY

The following presents a simplified summary to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a forward-fighting ballistic shield device. The device functions as a ground-deployed or carried shield to protect against ballistic blasts and fragmentation impacts. The device includes an aluminum frame attached to a ballistic panel with a polyurethane ballistic coating. A leg that is adjustable via a multi-point spring-hinge allows modification of the shield's angle when deployed on the ground. The leg may be telescopic with a locking mechanism and includes a stabilization foot. A tether further secures the leg at a desired angle through a reciprocating attachment structure.

When carried, the leg is secured to the frame using a leg holder fastener, such as an angled bracket, clip, or clamp, keeping it parallel to the frame. The frame may also feature deployable straps with grommets for staking the device to the ground to prevent movement upon impact.

The shield can be used in vertical or horizontal orientations, whether carried or ground-deployed. The rear of the device includes a rapidly inflatable ballistic panel made of an inflatable bladder and a ballistic insert. The bladder is constructed from bonded tensile filament materials and/or expanded, bonded foam-core, and is designed to absorb and distribute impact forces while limiting displacement upon projectile impact, and while keeping the ballistic panel flat on both sides when fully inflated.

It may be made from fabric-reinforced polyurethane, PVC, or similar materials and can be manually or gas-inflated via a valve or CO2 canister.

Once inflated, the panel can be secured to a user's arm using an adjustable strap, ensuring it moves as an extension of the user's body. A rigid, adjustable handle is also included for carrying, along with a MOLLE panel for attaching additional gear. A shield ballistic insert is positioned in front of the bladder, and offers varying levels of ballistic protection. The insert may be integrated within the panel or removable via a designated pocket.

Accordingly, the forward-fighting ballistic shield device of the present invention is particularly advantageous as it provides an improved ballistic shield that incorporates an adjustable leg with a multi-point spring hinge, allowing it to function as a stable ground-deployed shield with customizable angles. The leg is further equipped with a locking mechanism and tether system to maintain the desired positioning. When used as a carried shield, the leg can be secured to the frame, ensuring compactness and ease of transport. The rapidly inflatable ballistic panel with an integrated bladder system further provides additional protection while maintaining a low-profile storage state. The inflatable panel is reinforced with ballistic inserts, offering varying levels of protection against projectiles. Additionally, the panel includes arm straps and an adjustable handle for ergonomic handling, allowing it to move as an extension of the user's body. By combining modular functionality, rapid deployment capabilities, and enhanced protection, the device addresses the limitations of existing shields and provides a versatile solution for dynamic combat environments. In this manner, the forward-fighting ballistic shield device overcomes the limitations of existing ballistic shields known in the art.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
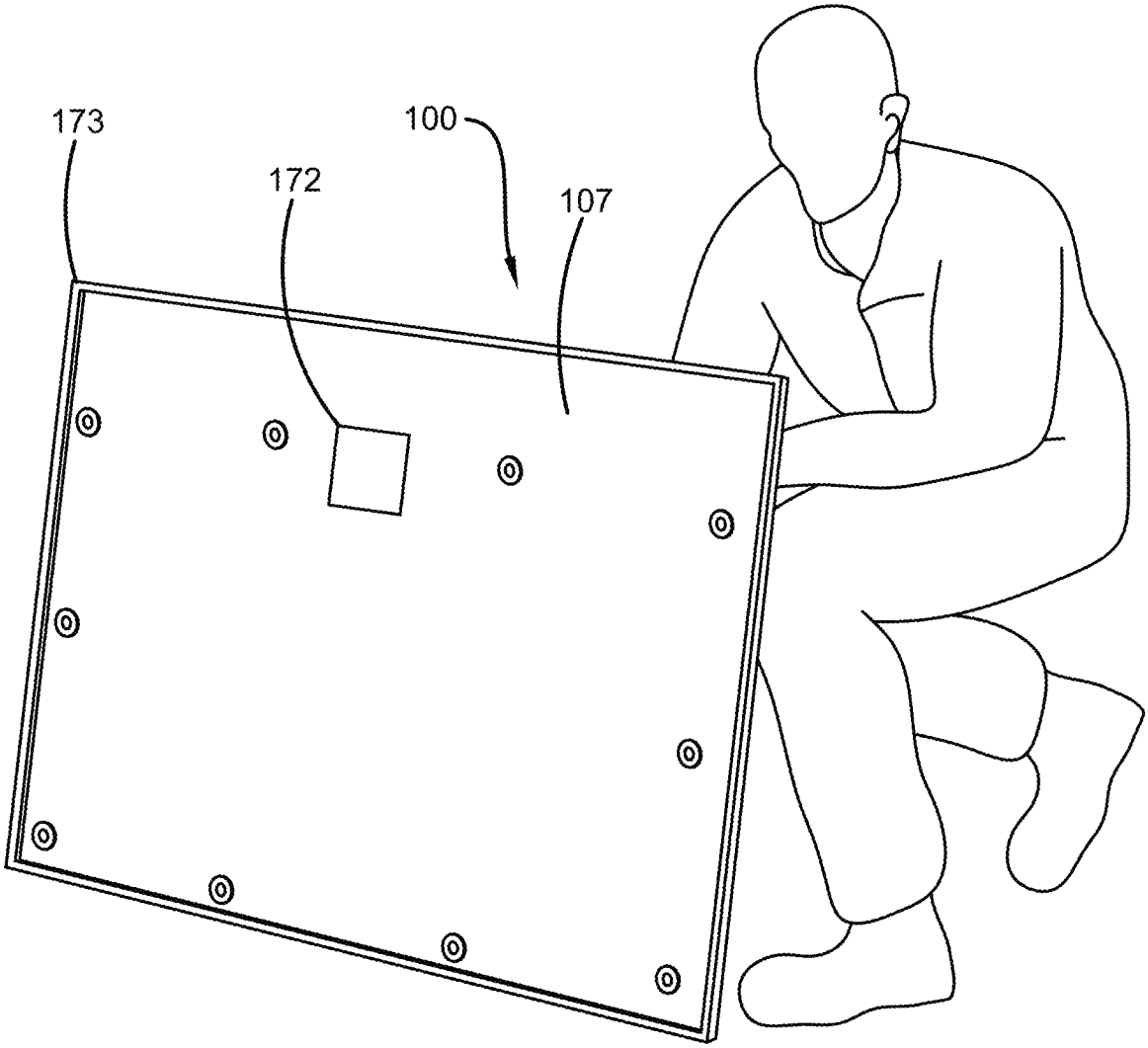
FIG. 1 illustrates a front perspective view of one potential embodiment of a forward-fighting ballistic shield device of the present invention while deployed in a free-standing perpendicular position to a ground surface in accordance with the disclosed architecture.

The innovation is now described with reference to the drawings, wherein like reference numerals are used to refer to like elements throughout. In the following description, for purposes of explanation, numerous specific details are set forth to provide a thorough understanding thereof. It may be evident, however, that the innovation can be practiced without these specific details. In other instances, well-known structures and devices are shown in block diagram form to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there exists a long-felt need in the art for an improved debris and ballistic shield that provides both mobile and stationary protection while maintaining user maneuverability. There also exists a long-felt need in the art for a forward-fighting position ballistic shield device that can be used as a free-standing, angled ground shield and as a carried shield to adapt to different combat scenarios. Moreover, there exists a long-felt need in the art for a ballistic shield that incorporates rapid deployment features, including an inflatable ballistic panel, to enhance protection without significantly increasing weight or bulk.

The present invention, in one exemplary embodiment, is comprised of a forward-fighting ballistic shield device. The device serves as a ground-deployed or carried shield to protect against ballistic blast and fragmentation impacts. The device features a frame assembly attached to a ballistic panel with a polyurethane ballistic coating. A leg, adjustable via a multi-point spring-hinge, allows for angle modification when deployed on the ground. The leg may be telescopic with a locking mechanism and includes a stabilization foot. A tether secures the leg at a desired angle through a reciprocating attachment structure.

When carried, the leg is secured to the frame using a leg holder fastener, such as an angled bracket, clip, or clamp, keeping it parallel to the frame. The frame may also include deployable straps with grommets for staking the device to the ground, preventing movement upon impact or blast.

The shield can be used in vertical or horizontal orientations, whether carried or ground-deployed. The rear of the device features a rapidly inflatable ballistic panel comprised of an inflatable bladder and a ballistic insert. The bladder, constructed from tensile materials and/or expanded foam-core, absorbs and distributes impact forces while limiting displacement upon projectile impact. It may be made from fabric-reinforced polyurethane, PVC, or similar materials and can be manually or gas-inflated via a valve or CO2 canister.

Once inflated, the panel can be secured to a user's arm using an adjustable strap, allowing it to move as an extension of the user's body. A rigid, adjustable handle is also included for carrying, along with a MOLLE panel for attaching additional gear. Positioned in front of the bladder, a shield ballistic insert provides varying levels of ballistic protection and may be integrated within the panel or removable via a designated pocket.

As a result, the forward-fighting ballistic shield device offers an improved design with an adjustable leg and multi-point spring hinge, allowing it to function as a stable ground-deployed shield with customizable angles. The leg incorporates a locking mechanism and tether system to maintain positioning. When carried, the leg is secured to the frame for compactness and ease of transport. The rapidly inflatable ballistic panel with an integrated bladder system enhances protection while maintaining a low-profile storage state. The inflatable panel is reinforced with ballistic inserts, providing varying levels of protection against projectiles. Additionally, the panel includes arm straps and an adjustable handle for ergonomic handling, allowing it to move in coordination with the user's body. By combining modular functionality, rapid deployment, and enhanced protection, the device addresses the limitations of existing shields, offering a versatile solution for dynamic combat environments.

Referring initially to the drawings, FIG. 1 illustrates a front perspective view of one potential embodiment of a forward-fighting ballistic shield device 100 of the present invention while deployed in a free-standing horizontal position on a ground surface in accordance with the disclosed architecture. The present invention is comprised of a forward-fighting position ballistic shield device 100. During use, the device 100 can be used as a ground-deployed shield or a carried shield to protect a user against ballistic blasts and/or fragmentation impacts.

The device 100 is comprised of an aluminum frame 170 attached to a ballistic panel 107 with a protective ballistic coating 172 that is preferably a polymer or polyurethane. In one embodiment, the frame 170 is comprised of an edge 173. The edge 173 is preferably a U-shaped channel that is also covering in the coating 172. The edge 173 prevents the interior components of the device 100 from becoming damaged in the event that the device 100 is dropped/thrown.

Figure 2:
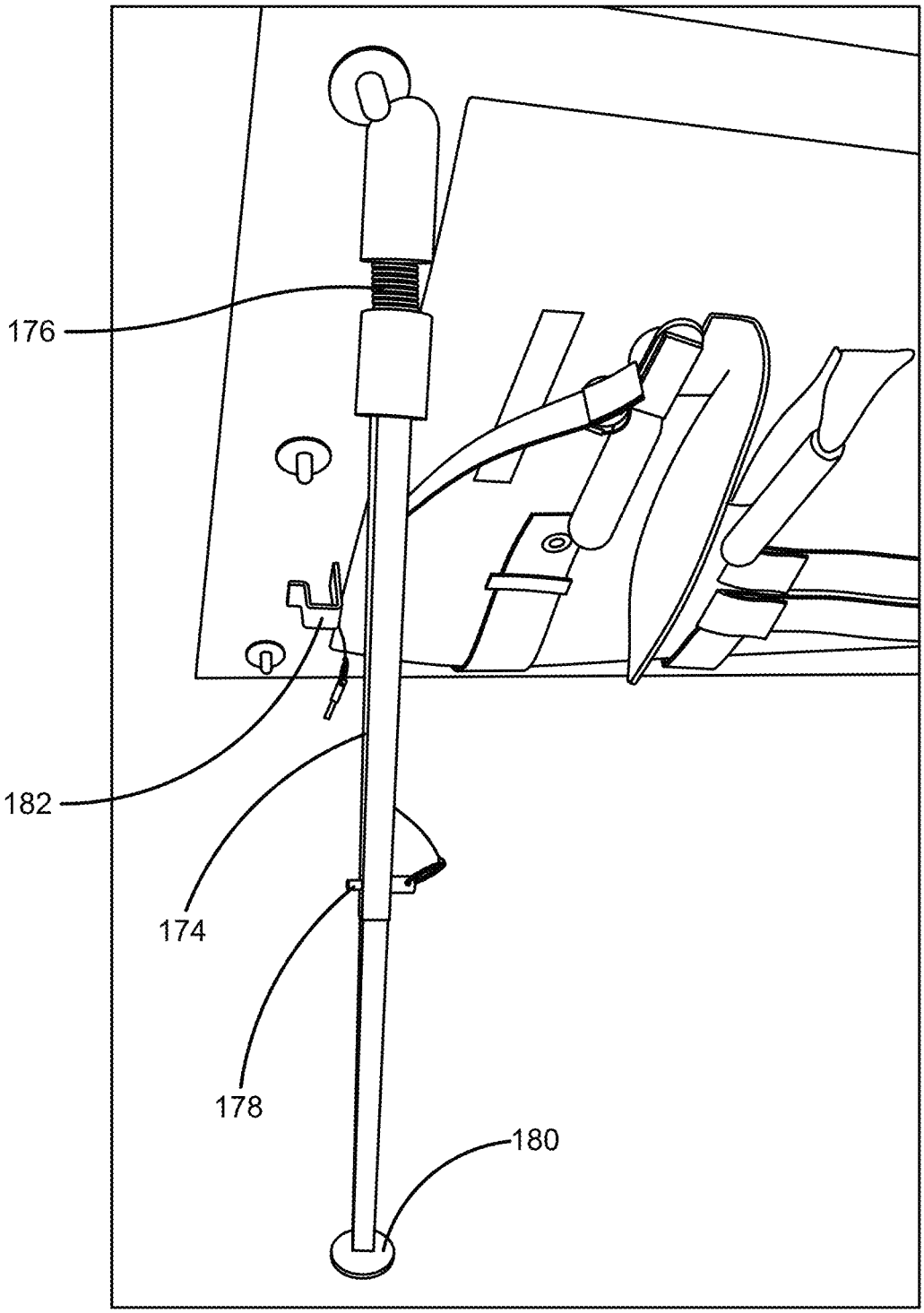
FIG. 2 illustrates a rear perspective view of one potential embodiment of a forward-fighting ballistic shield device of the present invention while deployed in a free-standing perpendicular position to a ground surface with the leg deployed in accordance with the disclosed architecture.

The device 100 is also comprised of at least one leg 174 that attaches to the frame via a multi-point spring-hinge 176 that allows the leg 174 to be angle adjustable to modify the overall angle of the device 100 when used as a ground-deployed shield, as seen in FIG. 2. In one embodiment, the leg 174 is telescopic, wherein the length of the leg 174 can be secured via a locking mechanism 178, such as a locking pin. The leg 174 is comprised of at least one foot 180 for stabilization. To ensure the leg 174 remains at the desired angle during use, the device 100 is comprised of a tether 175 attached to the leg 174, wherein the tether 175 attaches to a mounting point 179. The tether 175 and mounting point 179 may be any type of reciprocating attachment structure such as but not limited to male and female, ball and socket, ball and channel, etc. The length of the tether 175 may be adjustable and/or may be manufactured at desired lengths in order to limit the angle of the leg 174 relative to the frame 170 as desired.

Figure 3:
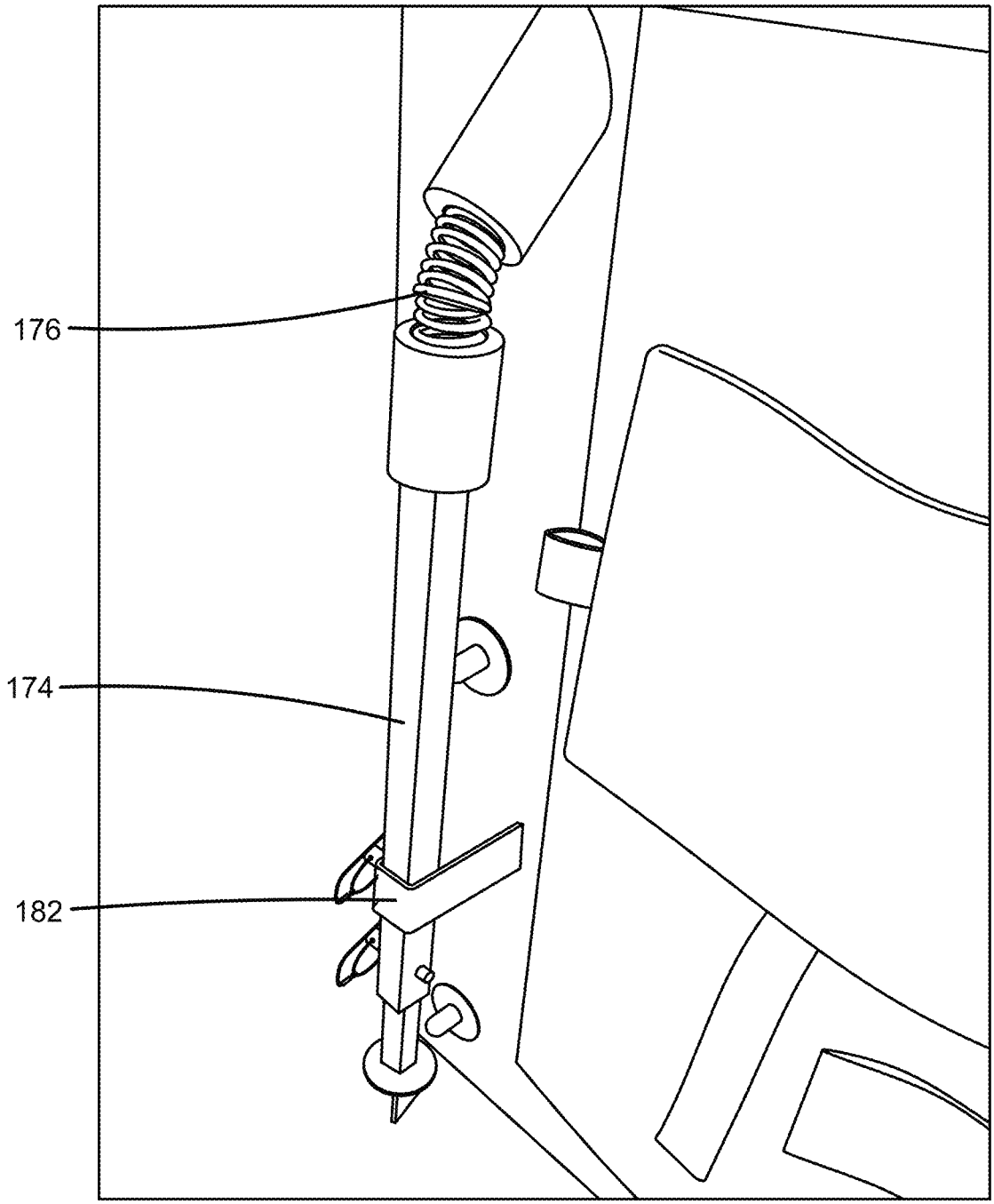
FIG. 3 illustrates a rear perspective view of one potential embodiment of a forward-fighting ballistic shield device of the present invention with the leg retracted in accordance with the disclosed architecture.
Figure 4:
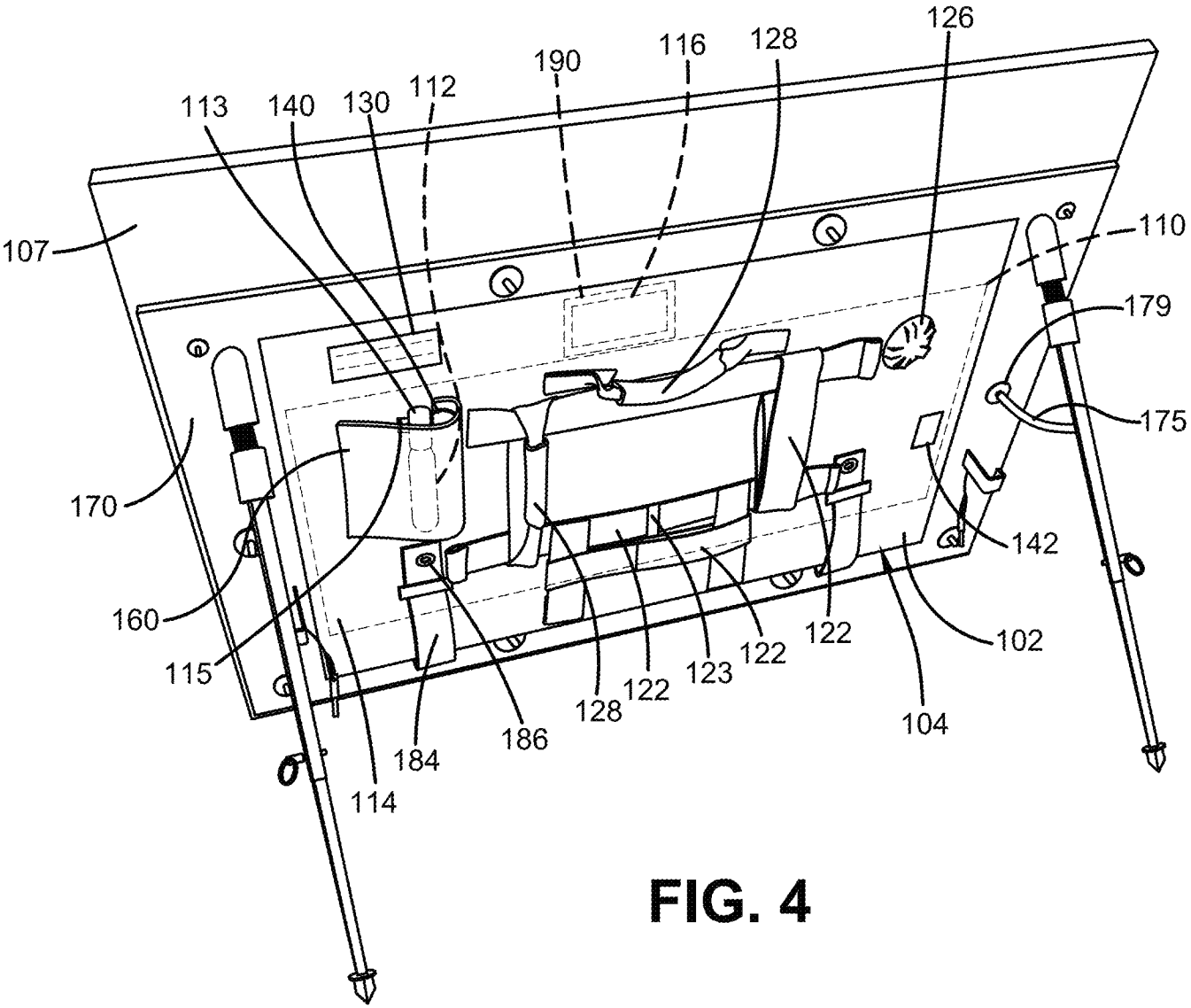
FIG. 4 illustrates a rear perspective view of one potential embodiment of a forward-fighting ballistic shield device of the present invention while deployed in a free-standing perpendicular position to a ground surface with the legs deployed in accordance with the disclosed architecture.
Figure 5:
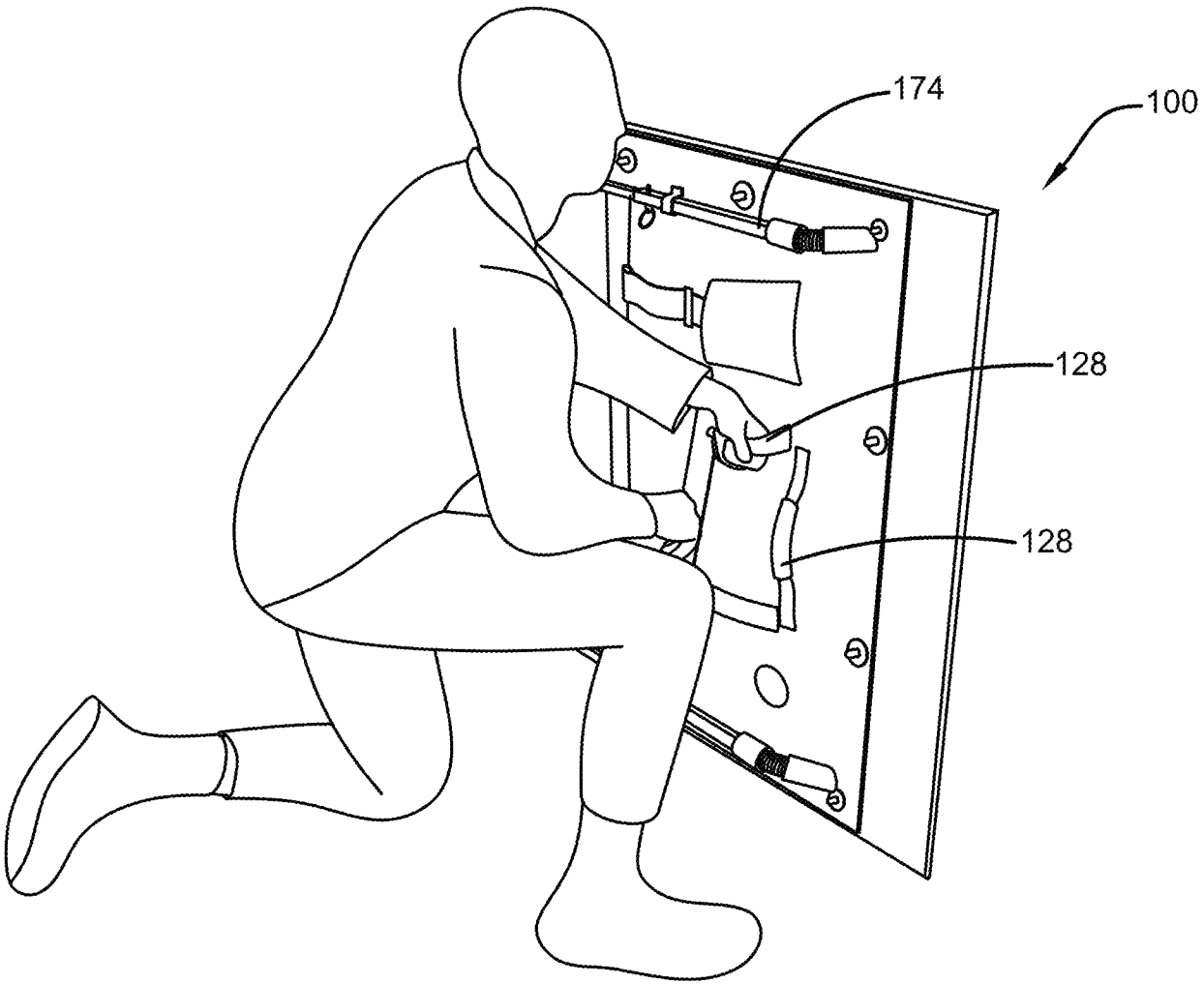
FIG. 5 illustrates a rear perspective view of one potential embodiment of a forward-fighting ballistic shield device of the present invention while deployed in a shield position while being held by a user in accordance with the disclosed architecture.

When the device 100 is being used as a carried shield (as seen in FIG. 5), the leg 174 can be secured to the frame 170 via at least one leg holder fastener 182 fixedly attached to the frame 170, as seen in FIG. 3. The fastener 182 is preferably an angled bracket but may also be but is not limited to a clip, clamp, or snap-fit fastener. When attached to the fastener 182, the leg 174 is generally parallel to the frame 170.

The frame 170 may also be comprised of at least one deployable strap 184 with at least one grommet 186 that can be used to stake the device 100 to a ground surface, preventing the device 100 from lifting or moving when impacted during use as a ground-deployed shield.

It should be appreciated that the device 100 may be used in a vertical or horizontal position, whether carried or ground-deployed. The rear of the device 100 receives at least one rapidly inflatable ballistic panel 104. The panel 104 is comprised of an inflatable ballistic shield with at least one inflatable bladder 110 and at least one shield ballistic insert 116. During use, the panel 104 can be stored in an uninflated state. Then, the panel 104 can be rapidly inflated.

The panel 104 is comprised of a body 102 made from a fabric material. Said material may include but is not limited to a param-aramid synthetic fiber, polyethylene, ballistic nylon, Cordura, reinforced coated fabric (PVC), etc. The body 102 may be any shape and size but is preferably rectangular.

The bladder 110 is located within the body 102. The bladder 110 is preferably a singular, flat bladder. However, in different embodiments the bladder 110 may be any size, style, and configuration of gas bladder known in the art, including but not limited to a quilted bladder, a chambered bladder, or any bladder style incorporating multiple inflated cells. The bladder 110 may be constructed using a plurality of tensile filaments/fibers that may be bonded and/or stitched. In one embodiment, the bladder 110 is an expanded and compactable foam-core bladder that is bonded to and sealed to the bladder 110 or any associated fabric material attached to the bladder. Once inflated, the filaments/fibers or the foam-core are placed in tension. This ensures that the bladder 110 will only be displaced in a limited and controlled manner when impacted with a projectile, and absorbs the force of the projectile impact and distributes the force of a projectile impact through the bladder 110.

The bladder 110 may be constructed of many different types of materials such as fabric-reinforced high-density polyurethane, polyvinyl chloride (PVC), plastic or any other suitable material types such as those used in children's bouncing jumpers. The material can be thin sheets such as 30 oz./yd$^2$ to 80 oz./yd$^2$ fabric weight, or any other suitable thickness or shape.

In one embodiment, the bladder 110 can be manually inflated with air via at least one valve 126 (of any valve type known in the art. This valve 126 also allows for rapid manual deflation of the bladder 110. In another embodiment, the bladder 110 can be inflated via at least one canister 112. The canister 112 preferably contains a gas, such as but not limited to CO2. The canister 112 attaches to at least one valve 113, which attaches to the bladder 110 via at least one fastener flange 115 such as but not limited to a thermal welded interface, glued interface, pinched joint, gasket seal, etc. The canister 112 is comprised of at least one pull tab 140 or other similar control that allows a user to release the gas within the canister 112 into the bladder 110 via the valve 113. The canister 112 attaches to the rear surface 114 of the body 102 via at least one fastener 160 such as but not limited to a loop, a hook and loop strap, a magnet, etc. The bladder 110 is preferably inflated to a range within 5-15 psi, but in different embodiments the range may be greater or smaller 1-30 psi.

After inflation, the body 102 can be attached to a user via at least one arm strap 122 located on the rear surface 114 of the body 102. The strap 122 is comprised of at least one fastener 123, such as but not limited to a hook and loop fastener, that allows the strap 122 to be tightened around a user's arm. It should be noted that once fastened around a user's arm, the user's arm contacts the rear surface 114, in contrast to existing ballistic shields wherein a user's arm is often cantilevered relative to the shield while in use. In this manner, the panel 104 moves more like an extension of the user's body. In one embodiment, the strap 122 may be any style of attachment mechanism that allows the body 102 to attach to a body area of a user.

The rear surface 114 may also be comprised of at least one rigid handle 128 that is adjustable in size/placement and that allows the device 100 to be held/carried, as seen in FIG. 5. The rear surface 114 may also be comprised of at least one MOLLE panel 130 for storage/attachment of various compatible items to the rear surface 114.

The body 102 is also comprised of at least one shield ballistic insert 116 that may be located within the body 102 and/or may be stitched to or enclosed by the body 102 (in a manner such that the panel 116 is separated from the bladder 110) in front of the bladder 110 (i.e., positioned such that the panel 116 is the first structure of the panel 104 to absorb a projectile impact). The shield ballistic insert 116 may be made from materials such as but not limited to aramid, ultra-high molecular weight polyethylene fiber (UHMWPE), Kevlar, fiberglass, ceramic, hard ballistic material, soft ballistic material, or any other soft or hard ballistic armor/panel material. In different embodiments, the panel 116 may offer NIJ Level IIA protection, NIJ Level II protection, NIJ Level IIIA protection, NIJ Level III protection, NIJ Level III+ protection, NIJ Level IV protection, etc. In one embodiment, the panel 116 can be added or removed to the body 102 via at least one pocket 190 positioned between the ballistic panel 104 and bladder 110.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "forward-fighting ballistic shield device" and "device" are interchangeable and refer to the forward-fighting ballistic shield device 100 of the present invention.

Notwithstanding the forgoing, the forward-fighting ballistic shield device 100 of the present invention and its various components can be of any suitable size and configuration as is known in the art without affecting the overall concept of the invention, provided that they accomplish the above-stated objectives. One of ordinary skill in the art will appreciate that the size, configuration, and material of the forward-fighting ballistic shield device 100 as shown in the FIGS. are for illustrative purposes only, and that many other sizes and shapes of the forward-fighting ballistic shield device 100 are well within the scope of the present disclosure. Although the dimensions of the forward-fighting ballistic shield device 100 are important design parameters for user convenience, the forward-fighting ballistic shield device 100 may be of any size, shape, and/or configuration that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications, and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A forward-fighting ballistic shield device comprising:
- a ballistic panel;
- a frame attached to the ballistic panel;
- an angle-adjustable leg attached to the frame via a hinge;
- a tether attached to the angle-adjustable leg, wherein the tether is configured to limit movement of the angle-adjustable leg relative to the frame;
- an inflatable ballistic panel attached to a rear of the ballistic panel, wherein the inflatable ballistic panel comprises:
  - a body made from a fabric material;
  - an inflatable bladder located within the body; and
  - a ballistic insert positioned in front of the inflatable bladder.

2. The forward-fighting ballistic shield device of claim 1, wherein the angle-adjustable leg is comprised of a telescopic leg.

3. The forward-fighting ballistic shield device of claim 2, wherein the angle-adjustable leg is comprised of a locking mechanism.

4. The forward-fighting ballistic shield device of claim 1, wherein the tether attaches to a mounting point on the frame.

5. The forward-fighting ballistic shield device of claim 1, wherein the inflatable bladder is comprised of a quilted bladder, a chambered bladder, or a bladder with a plurality of inflated cells.

6. The forward-fighting ballistic shield device of claim 1, wherein the inflatable ballistic panel is comprised of a pocket.

7. The forward-fighting ballistic shield device of claim 6, wherein the ballistic insert is positioned within the pocket.

8. A forward-fighting ballistic shield device comprising:
- a ballistic panel;
- a frame attached to the ballistic panel, the frame comprised of a strap;
- an angle-adjustable leg attached to the frame via a spring-hinge;

a tether attached to the angle-adjustable leg, wherein the tether is configured to limit movement of the angle-adjustable leg relative to the frame;

an inflatable ballistic panel attached to a rear of the ballistic panel, wherein the inflatable ballistic panel comprises:

a body made from a fabric material;

a handle;

an inflatable bladder located within the body; and a ballistic insert positioned in front of the inflatable bladder.

9. The forward-fighting ballistic shield device of claim 8, wherein the angle-adjustable leg is comprised of a foot.

10. The forward-fighting ballistic shield device of claim 8, wherein the inflatable bladder is comprised of a tensile filament.

11. The forward-fighting ballistic shield device of claim 8, wherein the inflatable bladder is comprised of a tensile fiber.

12. The forward-fighting ballistic shield device of claim 8 further comprised of a gas canister.

13. The forward-fighting ballistic shield device of claim 8, wherein the inflatable bladder is inflated to a pressure of between 5 psi to 15 psi.

14. A forward-fighting ballistic shield device comprising:

a ballistic panel;

a frame attached to the ballistic panel, the frame comprised of a strap;

an angle-adjustable leg attached to the frame via a spring-hinge;

a tether attached to the angle-adjustable leg, wherein the tether is configured to limit movement of the angle-adjustable leg relative to the frame;

an arm strap;

an inflatable ballistic panel attached to a rear of the ballistic panel, wherein the inflatable ballistic panel comprises:

a body;

a handle;

a valve;

an inflatable bladder located within the body; and a ballistic insert positioned in front of the inflatable bladder.

15. The forward-fighting ballistic shield device of claim 14, wherein the frame is comprised of a leg holder fastener.

16. The forward-fighting ballistic shield device of claim 15, wherein the leg holder fastener is comprised of an angled bracket.

17. The forward-fighting ballistic shield device of claim 14, wherein the inflatable bladder is comprised of an expandable and compactable foam-core bladder.

18. The forward-fighting ballistic shield device of claim 14, wherein the ballistic panel is comprised of a coating.

19. The forward-fighting ballistic shield device of claim 18, wherein the coating is comprised of a protective ballistic coating.

20. The forward-fighting ballistic shield device of claim 14, wherein the tether is comprised of a length-adjustable tether.

* * * * *